US005839923A

United States Patent [19]

Yoshida

[11] Patent Number: 5,839,923

[45] Date of Patent: Nov. 24, 1998

[54] CONNECTOR WITH TERMINAL WITHDRAWAL STOPPER

[75] Inventor: Kazuyuki Yoshida, Tokyo, Japan

[73] Assignee: The Furukawa Electric Co., Ltd., Tokyo, Japan

[21] Appl. No.: 770,786

[22] Filed: Dec. 20, 1996

[30] Foreign Application Priority Data

Dec. 22, 1995 [JP] Japan ..... 7-335254

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 5,205,763 | 4/1993 | Watanabe et al. | 439/752 |
| 5,516,308 | 5/1996 | Yamanashi | 439/752 |
| 5,634,826 | 6/1997 | Jean et al. | 439/752 |
| 5,647,775 | 7/1997 | Polgar et al. | 439/752 |

FOREIGN PATENT DOCUMENTS 4-23391 4/1992 Japan .

*Primary Examiner*—Gary F. Paumen

*Attorney, Agent, or Firm*—Armstrong, Westerman, Hattori, McLeland & Naughton

[57] ABSTRACT

A connector with a terminal withdrawal stopper superior in durability whereby temporary engagement is possible even if the terminal withdrawal stopper is repeatedly inserted and withdrawn. Windows are formed in the outermost plug pieces of the terminal withdrawal stopper. Projections for engagement with the rim of the window are provided at the inside surface of the two side walls of the housing. The engagement of the projections and the rims of the windows holds the engagement of the terminal withdrawal stopper. When inserting or withdrawing the terminal withdrawal stopper, since the plug pieces easily elastically deform, no unreasonable force is applied and breakage seldom occurs.

4 Claims, 6 Drawing Sheets

FIG.3A
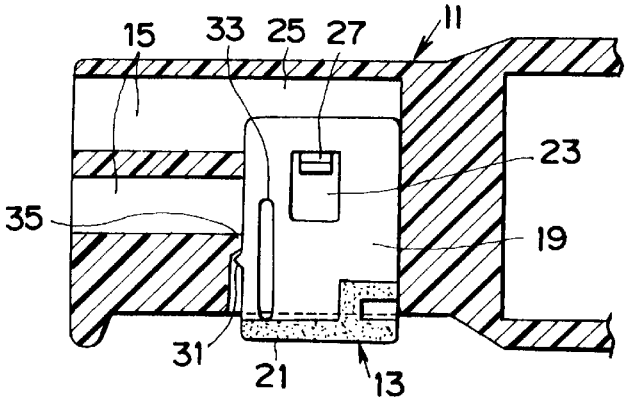
FIG.3B
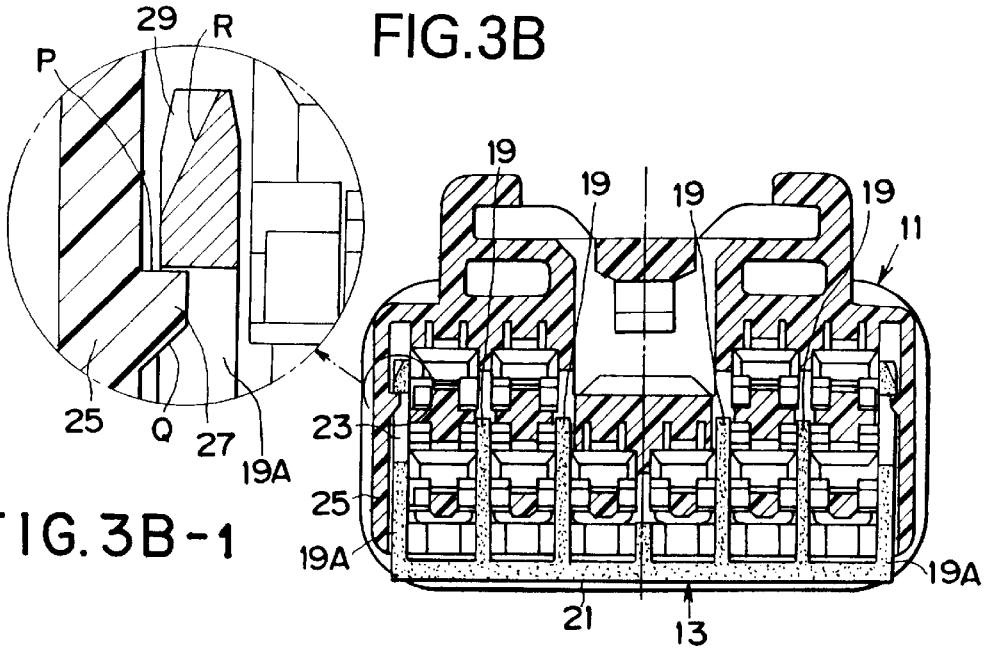
FIG.3B-1
FIG.3C
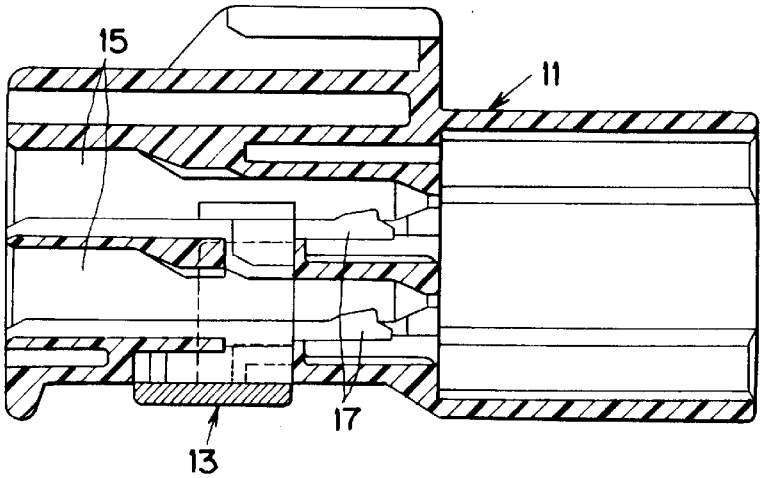

FIG.4A
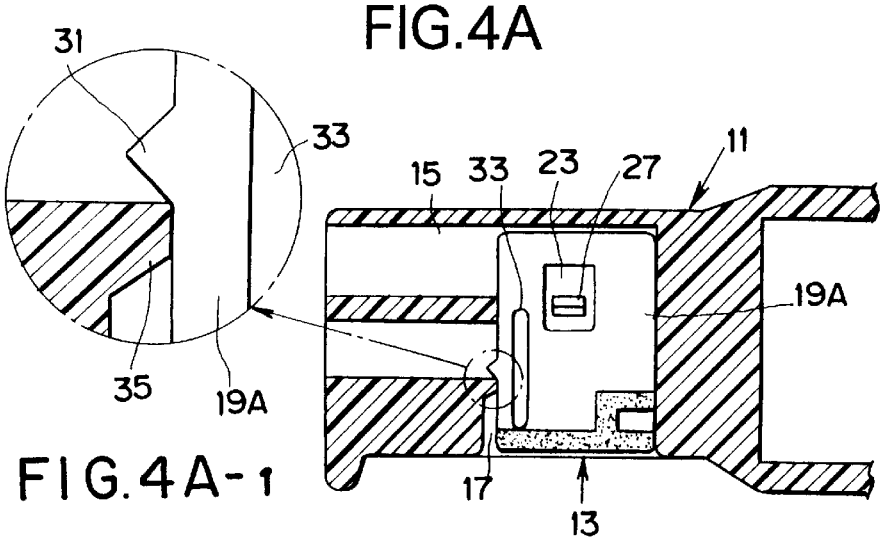
FIG.4A-1
FIG.4B
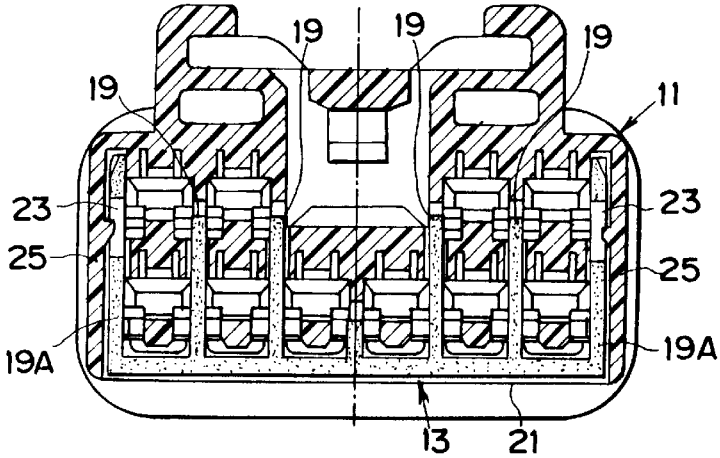
FIG.4C
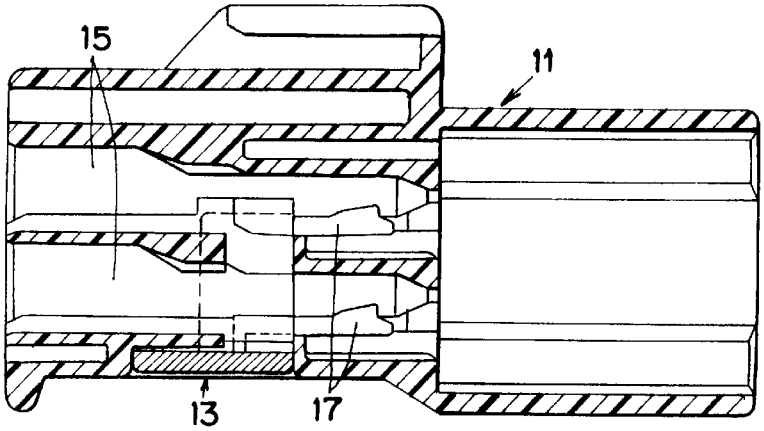

CONNECTOR WITH TERMINAL WITHDRAWAL STOPPER

BACKGROUND OF THE INVENTION

1. Field of the Invention

The present invention relates to a connector with a terminal withdrawal stopper provided at its housing.

The connector with a terminal withdrawal stopper of the present invention relates in particular to a connector with a terminal withdrawal stopper having a construction which prevents inadvertant withdrawal of the terminals due to movement, vibration, etc. in a vehicle such as an automobile or other moving body etc.

2. Description of the Related Art

The connectors used for the wiring inside cars and other vehicles are comprised of plastic housings provided with a predetermined number of terminal sockets for insertion of a corresponding number of terminals. Each of the terminals inserted into the terminal sockets has a conductor crimped at its end.

In such a vehicular connector etc., there is a greater chance of the terminals inserted in the terminal sockets loosening or withdrawing due to the motion and vibration of the vehicle compared with connectors used in a normal stationary state. To prevent withdrawal of the terminals inserted in the terminal sockets of such vehicular connectors, therefore, lock pieces are formed in the terminal sockets which allow easy insertion of the terminals, but prevent them from being unintentionally pulled out. These lock pieces alone, however, are not enough to reliably prevent withdrawal of terminals, so use has been made of a connector of a double-lock type with a special terminal withdrawal stopper provided at its housing. This terminal withdrawal stopper is attached to the housing after the terminals are inserted in the housing and prevent withdrawal of the terminals by engagement with catches etc. in the terminals.

If the housing and terminal withdrawal stopper are made as separate parts, however, not only do the work of assembly of the connector and inventory control become troublesome, but sometimes the attachment of the terminal withdrawal stopper is forgotten.

Therefore, for example, as disclosed in Japanese Examined Patent Publication (Kokoku) No. 4-23391, there has been proposed a connector with a terminal withdrawal stopper which has the terminal withdrawal stopper temporarily engaged with the housing in advance (placed in state enabling insertion of terminals) and enables the terminal withdrawal stopper to be pushed completely into the housing for full engagement (state preventing withdrawal of terminals) after the insertion of the terminals into the housing.

The terminal withdrawal stopper in the connector disclosed in Japanese Examined Patent Publication (Kokoku) No. 4-23391 is comprised of a plurality of plug pieces for plugging into the housing in a direction orthogonal to the terminal sockets of the housing and Joined by a connecting piece to form a single assembly (substantially comb-shaped in section). The state of temporary engagement of the terminal withdrawal stopper is held by pawls formed on the ends of the plug pieces which catch on the rims of the corresponding slots formed in the housing.

The above-mentioned connector with a terminal withdrawal stopper, however, has the problem that when the terminal withdrawal stopper is repeatedly inserted to and detached from the housing for changing terminals etc., the temporary engagement pawls end up breaking and temporary engagement no longer becomes possible. The reason for this breakage is believed to be as follows: When inserting and detaching the terminal withdrawal stopper to and from the housing, the plug pieces have to elastically deform in the direction of displacement of the pawls when the pawls ride over the rims of the slots of the housing. The above-mentioned connector, however, has the pawls formed in the thickness direction of the plug pieces (surface of plug pieces forming thickness), so the plug pieces have to elastically deform in the width direction for the pawls to ride over the rims of the slots. The plug pieces are highly rigid, however, so elastic deformation in that direction requires a large force. Therefore a large external force acts on the pawls at the time of insertion and withdrawal. When this is repeated, the resultant fatique breaks the pawls.

The above example related to a connector with a terminal withdrawal stopper for vehicular use, but a similar problem is encountered in all connectors which have housings provided with terminal withdrawal stoppers where the terminal withdrawal stoppers are repeatedly inserted and withdrawn to and from the housing.

SUMMARY OF THE INVENTION

An object of the present invention is to provide a connector with a terminal withdrawal stopper provided at its housing, wherein the housing and the terminal withdrawal stopper will not break even if the terminal withdrawal stopper is repeatedly inserted into and withdrawn from the housing. That is, the object of the present invention is to provide a connector with a terminal withdrawal stopper which is durable against insertion and withdrawal of the terminal withdrawal stopper to and from the housing while not hindering the insertion and detachment of the terminals into and from the terminal sockets and preventing inadvertant withdrawal of the terminals inserted in the terminal sockets.

According to a first aspect of the present invention, there is provided a connector with a terminal withdrawal stopper comprised of a housing having terminal sockets in which terminals are to be accommodated and lock pieces for receiving members for preventing withdrawal of the terminals accommodated in the terminal sockets in a direction orthogonal to the terminal sockets and a terminal withdrawal stopper having at least one plug piece for plugging into the lock pieces and preventing withdrawal of the terminals accommodated in the terminal sockets, the plug piece of the terminal withdrawal stopper being partially plugged into the lock piece of the housing in a temporary engagement state and the terminals being inserted into the terminal sockets and the plug piece of the terminal withdrawal stopper being fully plugged into the lock pieces of the housing in a full engagement state, wherein the housing has a projection on the path where the plug piece of the terminal withdrawal stopper is plugged into the lock piece of the housing and on a surface facing the plug piece and a projecting rim on the path where the plug piece is plugged and at a position below the terminal sockets and the plug piece of the terminal withdrawal stopper has a first window which engages with the projection of the housing when the terminal withdrawal stopper is partially plugged into the housing and into which the projection of the housing does not enter to prevent withdrawal of the plug piece from the lock piece when the terminal withdrawal stopper is fully plugged into the housing and a ridge for engaging with the projecting rim for stopping insertion of the plug piece with the projecting rim of the housing so as to stop further insertion when the terminal withdrawal stopper has been partially plugged into the housing.

Preferably, a plurality of the plug pieces are provided and these plurality of plug pieces are connected by a connecting piece at the side opposite to the plugging sides, the first window and the ridge are provided at least at one of the outside plug pieces located near one of the side walls of the housing, and the projection and projecting rim provided at the housing are provided on the side wall.

Specifically, the bottom surface of the projection provided at the side wall is inclined so as to enable the window of the plug piece to easily ride over the projection in the temporary engagement state and the top surface of the projection is flat so as to stop the top rim of the window riding over it in the temporary engagement state.

More specifically, the bottom surface of the projecting rim provided at the side wall is inclined so as to enable the ridge of the plug piece to abut against it in the temporary engagement state and enable the ridge to easily ride over it in the full engagement state and the top surface of the projecting rim is flat so as to stop the bottom rim of the ridge riding over it in the full engagement state.

According to a second aspect of the invention, there is provided a connector with a terminal withdrawal stopper comprised of a housing having terminal sockets in which terminals are to be accommodated and lock pieces for receiving members for preventing withdrawal of the terminals accommodated in the terminal sockets in a direction orthogonal to the terminal sockets and a terminal withdrawal stopper having at least one plug piece for plugging into the lock pieces and preventing withdrawal of the terminals accommodated in the terminal sockets, the plug piece of the terminal withdrawal stopper being partially plugged into the lock piece of the housing in a temporary engagement state and the terminals being inserted into the terminal sockets and the plug piece of the terminal withdrawal stopper being fully plugged into the lock pieces of the housing in a full engagement state, wherein the housing has a projection on the path where the plug piece of the terminal withdrawal stopper is plugged into the lock piece of the housing and on a surface facing the plug piece and a projecting rim on the path where the plug piece is plugged and at a position below the terminal sockets and the plug piece of the terminal withdrawal stopper has a first window which engages with the projection of the housing when the terminal withdrawal stopper is partially plugged into the housing and into which the projection of the housing does not enter to prevent withdrawal of the plug piece from the lock piece when the terminal withdrawal stopper is fully plugged into the housing, a second opening or notch which engages at its bottom rim with the bottom surface of the projection provided at the housing to stop further insertion when the terminal withdrawal stopper has been partially plugged into the housing, and a ridge for ridging over the projecting rim of the housing and engaging with the top surface of the projecting rim for preventing withdrawal of the terminal withdrawal stopper from the housing when the terminal withdrawal stopper has been partially plugged into the housing.

Preferably, a plurality of the plug pieces are provided and these plurality of plug pieces are connected by a connecting piece at the side opposite to the plugging sides, the first window and the ridge are provided at least at one of the outside plug pieces located near one of the side walls of the housing, and the projection and projecting rim provided at the housing are provided on the side wall.

Specifically, the bottom surface of the projection provided at the side wall is inclined so as to enable the first window of the plug piece to easily ride over the projection in the full engagement state and the top surface of the projection is flat so as to stop the top rim of the window riding over it in the full engagement state.

More specifically, the bottom surface of the projecting rim provided at the side wall is inclined so as to enable the ridge of the plug piece to easily ride over it in the temporary engagement state and the top surface of the projecting rim is flat so as to stop the bottom rim of the ridge riding over it in the temporary engagement state.

According to a third aspect of the present invention, there is provided a connector with a terminal withdrawal stopper comprised of a housing having terminal sockets in which terminals are to be accommodated and lock pieces for receiving members for preventing withdrawal of the terminals accommodated in the terminal sockets in a direction orthogonal to the terminal sockets and a terminal withdrawal stopper having at least one plug piece for plugging into the lock pieces and preventing withdrawal of the terminals accommodated in the terminal sockets, the plug piece of the terminal withdrawal stopper being partially plugged into the lock piece of the housing in a temporary engagement state and the terminals being inserted into the terminal sockets and the plug piece of the terminal withdrawal stopper being fully plugged into the lock pieces of the housing in a full engagement state, wherein a projection on the path where the plug piece of the terminal withdrawal stopper is plugged into the lock piece of the housing and on the surface facing the plug piece and a projecting rim on the path where the plug piece is plugged in and at a position below the terminal sockets and the plug piece of the terminal withdrawal stopper has a first window which does not engage with the projection of the housing when the terminal withdrawal stopper is partially plugged into the housing and into which the projection of the housing enters for preventing withdrawal of the plug piece from the lock piece when the terminal withdrawal stopper is fully plugged into the housing and a second opening or notch which engages at its bottom rim with the bottom surface of the projection provided at the housing to stop further insertion when the terminal withdrawal stopper has been partially plugged into the housing.

Preferably, a plurality of the plug pieces are provided and these plurality of plug pieces are connected by a connecting piece at the side opposite to the plugging sides, the first window and the ridge are provided at least at one of the outside plug pieces located near one of the side walls of the housing, and the projection and projecting rim provided at the housing are provided on the side wall.

Specifically, the bottom surface of the projection provided at the side wall is inclined so as to enable the first window of the plug piece to easily ride over the projection in the full engagement state and the top surface of the projection is flat so as to stop the top rim of the window riding over it in the full engagement state.

According to a fourth aspect of the invention, there is provided a connector with a terminal withdrawal stopper comprised of a housing having a plurality of terminal sockets and a terminal withdrawal stopper comprised of a plurality of plug pieces to be plugged into the housing in a direction orthogonal with the terminal sockets and connected by a connecting piece, the terminal withdrawal stopper being assembled into the housing so as to maintain a temporary engagement state before the terminals are accommodated in the terminal sockets and a full engagement state after the terminals are accommodated in the terminal sockets, the connector with a terminal withdrawal stopper characterized in that the terminal withdrawal stopper has a window at least at one plug piece and the housing has a projection for engaging with a rim of the window when the terminal withdrawal stopper is in the temporary engagement state or full engagement state.

BRIEF DESCRIPTION OF THE DRAWINGS

These and other objects and features of the present invention will become clearer from the following description given with reference to the attached drawings, in which:

FIGS. 3A to 3C are sectional views along the lines A—A, B—B, and C—C of FIG. 2 when the terminal withdrawal stopper is temporarily engaged with the housing;

FIGS. 4A to 4C are sectional views along the lines A—A, B—B, and C—C of FIG. 2 when the terminal withdrawal stopper is fully engaged with the housing;

DESCRIPTION OF THE PREFERRED EMBODIMENTS

First Embodiment

A first embodiment of the connector with a terminal withdrawal stopper of the present invention will be explained next with reference to FIG. 1 to FIGS. 4A to 4C.

Figure 1:
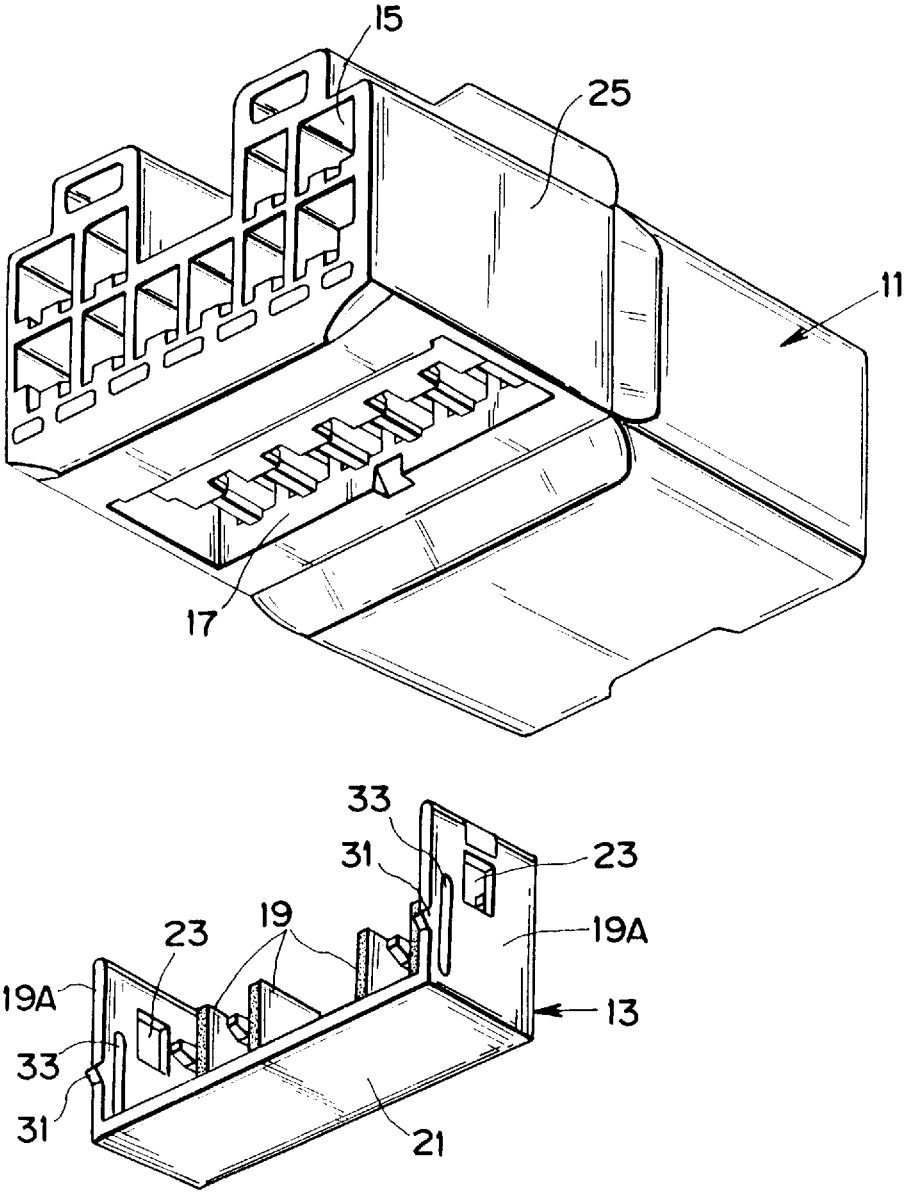
FIG. 1 is a perspective disassembled view of a connector with a terminal withdrawal stopper according to a first embodiment of the present invention.
Figure 2A:
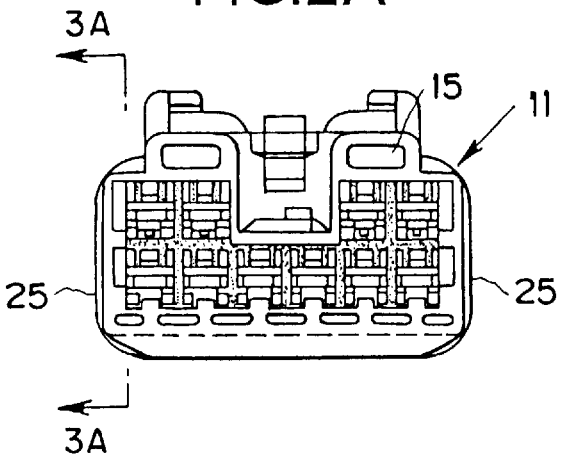
FIGS. 2A to 2C are a front view, side view, and rear view of a connector with a terminal withdrawal stopper illustrated in the perspective view of FIG. 1.
Figure 2B:
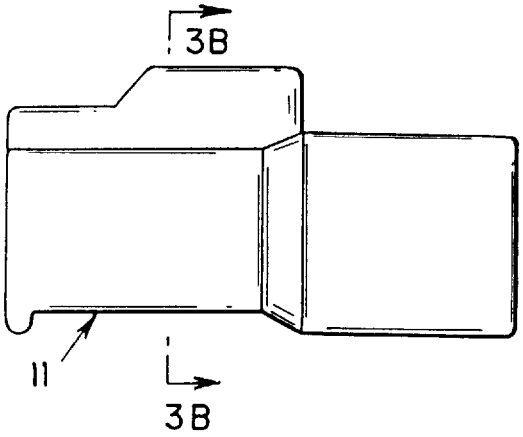
Figure 2C:
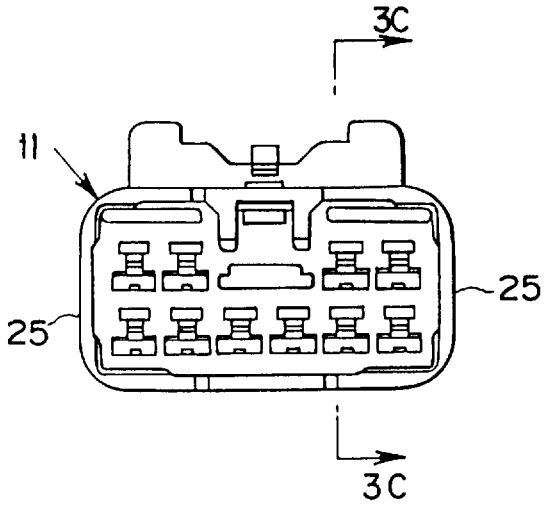

FIG. 1 is a perspective disassembled view of a connector with a terminal withdrawal stopper according to a first embodiment of the present invention. FIGS. 2A to 2C are a front view, side view, and rear view of a connector with a terminal withdrawal stopper illustrated in the perspective view of FIG. 1.

The connector with a terminal withdrawal stopper of the first embodiment is provided with a housing 11 comprised of a piece of molded plastic and a terminal withdrawal stopper 13.

The housing 11 has a plurality of terminal sockets 15 for accommodating (plugging in) terminals between its side walls 25. Illustration of the terminals inserted in the terminal sockets 15 is omitted. The housing 11 is also formed with a plurality of terminal withdrawal stopper slots 17 in a direction orthogonal to the terminal sockets 15 for preventing the terminals from withdrawing from the terminal sockets 15 after insertion.

Inside each terminal socket 15, as shown in FIG. 3C and FIG. 4C, is formed a lock piece 17 for preventing withdrawal of the terminal inserted in the terminal socket 15.

FIGS. 3A to 3C are sectional views along the lines A—A, B—B, and C—C of FIG. 2 when the terminal withdrawal stopper 13 is temporarily engaged with the housing 11. FIGS. 4A to 4C are sectional views along the lines A—A, B—B, and C—C of FIG. 2 when the terminal withdrawal stopper 13 is fully engaged with the housing 11.

The terminal withdrawal stopper 13, as illustrated in FIG. 1, has a plurality of plug pieces 19, 19A provided in a direction orthogonal to the terminal sockets 15 of the housing 11 and to be plugged into the plurality of lock pieces 17. The outside plug pieces 19A, 19A and the inside plug pieces 19 are joined by a connecting piece 21. The sectional shape of the plug pieces 19, 19A joined by the connecting piece 21 and the connecting piece 21 is, as illustrated in FIG. 3B and FIG. 4B, that of a comb.

FIGS. 3A to 3C show the state where the terminal withdrawal stopper 13 is temporarily engaged with the housing 11. This state of temporary engagement means a state where the terminal withdrawal stopper 13 is not fully plugged into the housing 11.

If the terminals are inserted until a predetermined position of the terminal sockets 15 in this temporary engagement state, they engage with the lock pieces 17. Due to the lock pieces 17, the terminals can no longer be pulled out by an ordinary pulling force. In the temporary engagement state, the terminal withdrawal stopper 13 does not hinder insertion of the terminals in the terminal sockets 15.

After the terminals are inserted into the terminal sockets 15, the terminal withdrawal stopper 13 is pushed fully into the housing 11, whereby the full engagement state illustrated in FIGS. 4A to 4C is achieved. In this full engagement state, the front ends of the plug pieces 19, 19A for example enter into the catches of the terminals accommodated in the terminal sockets 15 and engaged with the lock pieces 17 thereby preventing withdrawal of the terminals. Accordingly, the terminals are doubly locked by the lock pieces engaged inside the terminal sockets 15 and the plug pieces 19, 19A thereby resulting in a more reliable prevention of withdrawal of terminals from the terminal sockets 15.

In the outermost plug pieces 19A of the terminal withdrawal stopper 13 are formed windows (holes) 23. The outside plug pieces 19A are longer than the inside plug pieces 19.

At the inside surfaces of the two side walls 25, 25 of the housing 11, as shown in FIGS. 3A and 3B, are formed large projections 27 which fit into the windows 23 of the outside plug pieces 19A. When the terminal withdrawal stopper 13 is in the temporary engagement state, the windows 23 and projections 27 engage as illustrated in FIGS. 3A and 3B and keep the terminal withdrawal stopper 13 from detaching from the housing 11. The surfaces P of the projections 27 of the side walls 25 which engage with the rims of the windows 23, as shown partially enlarged in FIG. 3B, are substantially perpendicular to the inside surfaces of the side walls 25. The surfaces on the other sides of the surfaces P form inclines Q with respect to the inside surfaces of the side walls 25. Explaining the reason for forming them in this way, when rising up from below the projections 27, the windows 23 of the outside plug pieces 19A slide over the inclines Q of the projections 27 to ride over the projections 27. The reason for the above configuration is so that after they ride over the surfaces P of the projections 27, they are engaged there and the outside plug pieces 19A are kept from descending.

Grooves 29 are formed in the front ends of the outside plug pieces 19A. The width of the grooves 29 is somewhat larger than the width of the projections 27. The bottoms of the grooves form inclines R to the same side of the above-mentioned inclines Q. By adopting this configuration, when the terminal withdrawal stopper 13 is inserted into the housing 11, the front ends of the outside plug pieces 19A merely displace somewhat inward, smoothly slide over the inclines Q of the projections 27, and ride over the projections 27 to give the temporary engagement state illustrated in FIGS. 3A to 3C.

To detach the terminal withdrawal stopper 13 from the housing 11, it is sufficient to insert a minus screwdriver etc. between the outside plug piece 19A and housing side wall 25 to separate the surface of the side wall 25 from the surface of the outside plug piece 19A and release the engagement with the top rim of the window of the outside plug piece 19A riding over the surface P.

On the thickness surface of the outside plug pieces 19A, as shown in FIGS. 3A and 4A, are formed ridges 31 for use for the full engagement. Near the ridges 31 of the outside plug pieces 19A are formed slots 33 running parallel to the thickness surface (surface of plug pieces 19 forming thickness). The ridges 31 are located as shown in FIG. 3A when the terminal withdrawal stopper 13 is in the temporary engagement state and therefore do not function to prevent detachment of the terminal withdrawal stopper 13. The ridges 31, however, prevent the terminal withdrawal stopper 13 from entering into the housing 11 any further by engagement with the projecting rims 35 formed on the housing 11 side.

If the terminal withdrawal stopper 13 is pushed into the housing 11 from the state illustrated in FIG. 3A, the ridges 31 ride over the projecting rims 35 and become located as illustrated in FIG. 4A. The slots 33 are for facilitating the elastic deformation when the ridges 31 ride over the projecting rims 35. In the state illustrated in FIG. 4A, the ridges 31 engage with the insides of the projecting rims 35 and work to hold the terminal withdrawal stopper 13 at that position. That is, the full engagement state is held.

As explained above, in the connector with a terminal withdrawal stopper of the first embodiment of the present invention, it is possible to hold the terminal withdrawal stopper 13 in the temporary engagement state or full engagement state with the housing 11 by the engagement between the top rims of the windows 23 formed in the outside plug pieces 19A and the side walls 25 of the housing 11. By adopting this configuration, when inserting or withdrawing the terminal withdrawal stopper 13 to and from the housing 11, the top rims of the windows 23 can ride over the projections 27 by the elastic deformation in the thickness direction of the outside plug pieces 19A (elastic deformation in direction where width surface bends), so no large force is applied to the rims of the windows 23 and the projections 27. As a result, even if the terminal withdrawal stopper 13 is repeatedly inserted into and withdrawn from the housing 11, the connector with a terminal withdrawal stopper will not break and the durability will be improved.

Second Embodiment

A second embodiment of the connector with a terminal withdrawal stopper of the present invention will be explained next with reference to FIG. 5 and FIG. 6.

Figure 5:
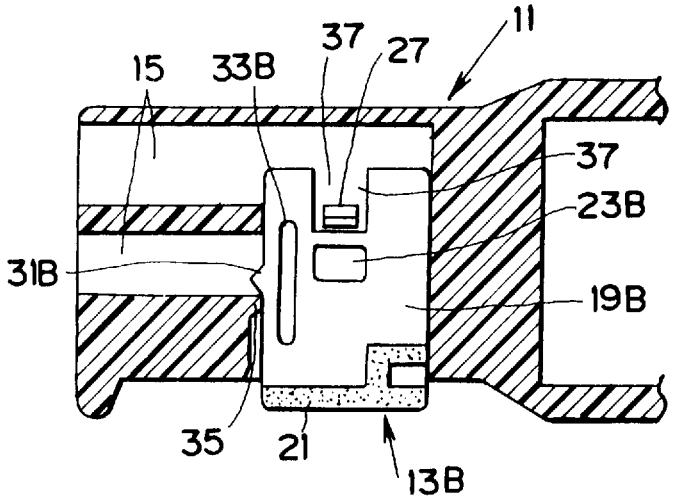
FIG. 5 is a sectional view along the line A—A of FIG. 2 when the terminal withdrawal stopper of a connector with a terminal withdrawal stopper of a second embodiment of the present invention is temporarily engaged with the housing.

FIG. 5 is a sectional view along the line A—A of FIG. 2 when the terminal withdrawal stopper 13B is temporarily engaged with the housing 11. FIG. 6 is a sectional view along the line A—A of FIG. 2 when the terminal withdrawal stopper 13B is fully engaged with the housing 11.

The basic configuration of the housing 11 and terminal withdrawal stopper 13B is similar to that shown in FIG. 1, FIGS. 2A to 2C, FIGS. 3A to 3C, and FIGS. 4A to 4C.

The differences between the first embodiment and the second embodiment lie in the shape of the outside plug pieces 19A of the first embodiment and the shape of the outside plug pieces 19B of the second embodiment. Details will be explained below.

First difference: The outside plug pieces 19A of the first embodiment, as illustrated in FIG. 3A, had long, large windows 23 for abutting with the projections 27. The projections 27 were engaged with the top rims of the windows 23 in the temporary engagement state. The outside plug pieces 19B of the second embodiment, as illustrated in FIG. 5, have small windows (first windows) 23B on top of which are provided open windows (notches, second windows) 37 with lower rims which engage with the projections 27. In other words, in the second embodiment, in the temporary engagement state, the projections 27 engage with the lower rims of the open windows 37, while in the full engagement state, the outside plug pieces 19B are formed so that the projections 27 engage with the top rims of the windows 23B.

Second difference: The position of the ridges 31 and slots 33 in the first embodiment differ from the positions of the ridges 31B and slots 33B in the outside plug pieces 19B of the second embodiment. That is, in the temporary engagement state of the terminal withdrawal stopper 13 with the housing 11, in the first embodiment, the ridges 31 of the outside plug pieces 19A are located below the projecting rims 35 of the housing 11 as illustrated in FIG. 3A, while in the second embodiment, the ridges 31B ride over the projecting rims 35 and are located at the position as illustrated in FIG. 5. In the full engagement state of the terminal withdrawal stopper 13B with the housing 11, in the first embodiment, the ridges 31 of the outside plug pieces 19A ride over the projecting rims 35 of the housing 11 and are located at positions held by the projecting rims 35 as illustrated in FIG. 4A, while in the second embodiment, the ridges 31B ride far over the projecting rims 35 and reach to the bottom of the frame 15A defining the terminal sockets 15 as illustrated in FIG. 6. The first embodiment and second embodiment are the same in that the ridges 31, 31B are formed at center positions of the slots 33, 33B. That is, the ridges 31B and slots 33B of the second embodiment are formed at positions higher than the ridges 31 and slots 33 of the second embodiment.

The temporary engagement state and full engagement state of the second embodiment will be explained next.

When the terminal withdrawal stopper 13B is in the temporary engagement state with respect to the housing 11, the ridges 31B engage with the top rims 35 of the housing 11 as shown in FIG. 5 so that the terminal withdrawal stopper 13 will not detach from the housing 11. In this temporary engagement state, the projections 27 still do not fit into the windows 23B and are located at the open windows 37.

Figure 6:
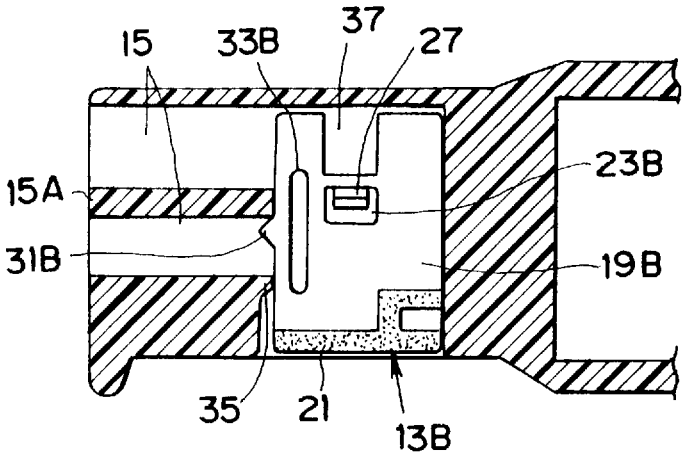
FIG. 6 is a sectional view along the line A—A of FIG. 2 when the terminal withdrawal stopper of a connector with a terminal withdrawal stopper of a second embodiment of the present invention is fully engaged with the housing.

If the terminal withdrawal stopper 13B is pushed in further from this temporary engagement state to the housing 11, the full engagement state shown in FIG. 6 is achieved.

In the full engagement state, the ridges 31B are pushed up away from the lower rims of the projecting rims 35, the projections 27 enter into the windows 23B, and the projections 37 engage with the top rims of the windows 23B, so the terminal withdrawal stopper 13B is held at that position.

The rest is the same as in the first embodiment.

Modification of Second Embodiment

The open windows 37, that is, the second windows, above the first windows 23B do not have to be open. They merely need to be windows of a size not obstructing the projections 27. In this case as well, temporary engagement and full engagement of the terminal withdrawal stopper 13B with the housing 11 are achieved similarly as in the second embodiment explained above.

As explained above, in the connector with a terminal withdrawal stopper of the second embodiment of the present invention, the engagement between the first windows 23B and second windows (open windows) 37 formed in the outside plug pieces 19B of the housing 11 with the projections 27 formed in the side walls 25 of the housing 11 and the engagement between the projecting rims 35 provided at the housing 11 and the ridges 31B (and slots 33B) provided at the outside plug pieces 19B work together to enable the terminal withdrawal stopper 13B to be held in the temporary engagement state or full engagement state with the housing 11. If this configuration is adopted, then when the terminal withdrawal stopper 13B is inserted and withdrawn with respect to the housing 11, the top rims of the first windows 23B will ride over the projections 27 due to the elastic deformation in the thickness direction of the outside plug pieces 19B (elastic deformation in direction where width surface bends), so no large force will be applied to the rims of the windows 23B and projections 27. As a result, in the second embodiment as well, the connector with a terminal withdrawal stopper will not break and durability will be improved even if the terminal withdrawal stopper 13B is repeatedly inserted and withdrawn to and from the housing 11.

Third Embodiment

A third embodiment of the connector with a terminal withdrawal stopper of the present invention will be explained next with reference to FIG. 7 and FIG. 8.

Figure 7:
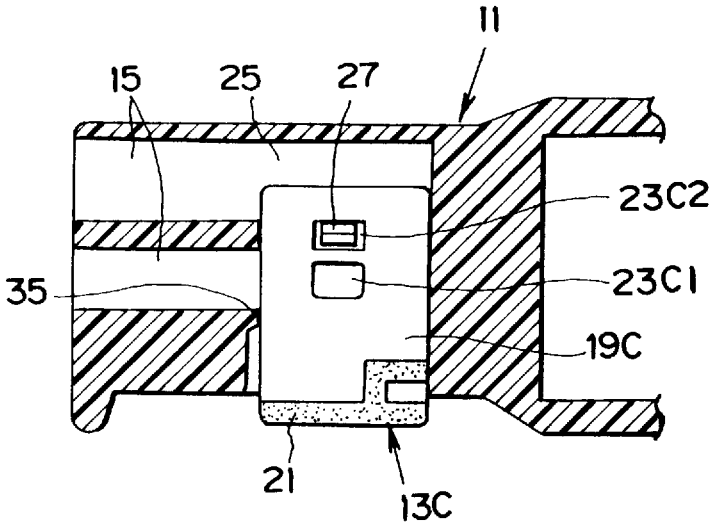
FIG. 7 is a sectional view along the line A—A of FIG. 2 when the terminal withdrawal stopper of a connector with a terminal withdrawal stopper of a third embodiment of the present invention is temporarily engaged with the housing.

FIG. 7 is a sectional view along the line A—A of FIG. 2 when the terminal withdrawal stopper 13 is temporarily engaged with the housing 11. FIG. 8 is a sectional view along the line A—A of FIG. 2 when the terminal withdrawal stopper 13 is fully engaged with the housing 11. FIG. 7 corresponds to FIG. 3A and FIG. 5, while FIG. 8 corresponds to FIG. 4A and FIG. 6.

The basic configuration of the housing 11 and terminal withdrawal stopper 13 is similar to that shown in FIG. 1, FIGS. 2A to 2C, FIGS. 3A to 3C, and FIGS. 4A to 4C.

The differences between the second embodiment and the third embodiment lie in the shape of the outside plug pieces 19B of the second embodiment and the shape of the outside plug pieces 19C of the third embodiment. Details will be explained below.

First difference: The outside plug pieces 19B of the second embodiment, as illustrated in FIG. 5, were formed with open windows (or notches) 37 above the windows 23B where the projections 27 abutted. As a modification of the second embodiment, it was mentioned that the open windows 37 could be formed by ordinary windows, but in the outside plug pieces 19C of the third embodiment, second windows 23C2 are provided above the first windows 23C1 corresponding to the first windows 23B in the second embodiment. In the temporary engagement state, as illustrated in FIG. 7, the projections 27 enter into the second windows 23C2, while in the full engagement state, as illustrated in FIG. 8, the projections engage with the first windows 231C1.

Second difference: The ridges 31B and slots 33B in the second embodiment are eliminated in the third embodiment.

The temporary engagement state and full engagement state of the third embodiment will be explained next.

When the terminal withdrawal stopper 13C is in the temporary engagement state with respect to the housing 11, the projections 27 enter into the second windows 23C2 as shown in FIG. 7 and engage with the rims so that the terminal withdrawal stopper 13 will not detach from the housing 11.

Figure 8:
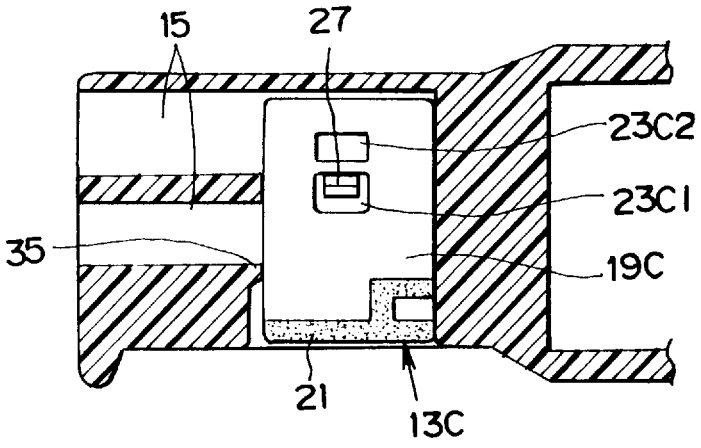
FIG. 8 is a sectional view along the line A—A of FIG. 2 when the terminal withdrawal stopper of a connector with a terminal withdrawal stopper of a third embodiment of the present invention is fully engaged with the housing.

If the terminal withdrawal stopper 13C is pushed in further from this temporary engagement state to the housing 11, the full engagement state shown in FIG. 8 is achieved.

In the full engagement state, the projections 27 enter into the first windows 23C1 and engage with the rims so that the terminal withdrawal stopper 13 is held at that position.

That is, in the third embodiment, engagement between the ridges 31B and rims 35 is not used. The rest of the embodiment is the same as the second embodiment.

As explained above, in the connector with a terminal withdrawal stopper of the third embodiment of the present invention, the engagement between the housing and the second windows 23C1 and the second windows 23C2 formed in the outside plug pieces 19C enables the terminal withdrawal stopper 13 to be held in the temporary engagement state or full engagement state with the housing 11. If this configuration is adopted, then like with the first embodiment and second embodiment, even if the terminal withdrawal stopper 13C is repeatedly inserted and withdrawn with respect to the housing 11, the connector with a terminal withdrawal stopper will not break and the durability will be improved.

As explained above, according to the present invention, the temporary engagement state or the full engagement state is held by the engagement of the rims of the windows formed in the plug pieces of the terminal withdrawal stopper and the projections formed at the inside of the housing, so no large external force acts on the window rims and projections at the time of insertion and withdrawal of the terminal withdrawal stopper and thus it is possible to obtain a connector with a terminal withdrawal stopper with a high durability which will seldom break even if repeatedly inserted or withdrawn.

I claim:

1. The combination of a connector with a terminal withdrawal stopper in which said connector includes:

a housing defined by generally rectangularly disposed walls and having terminal sockets in which terminals are to be accommodated, and lock pieces engageable with terminals installed in said terminal sockets for preventing withdrawal of said terminals therefrom, and a terminal withdrawal stopper having plug pieces insertable into said terminal sockets in a direction orthogonal to the direction of inserting said terminals therein for engaging said lock pieces to prevent withdrawal of said terminals from said sockets, and means for installing said terminal withdrawal stopper in said connector in stages including a temporary engagement stage in which said plug pieces are partially installed in said connector housing and a full engagement stage in which said plug pieces of said terminal withdrawal stopper engage said lock pieces in said housing to prevent removal of said terminals from said sockets, said means comprising:

said walls of said housing including a wall containing slots for reception of said plug pieces in a direction orthogonal to the direction of said terminal sockets, and side walls each having a projection formed on the inside surface thereof, said plug pieces of said terminal withdrawal stopper including outside plug pieces containing windows so disposed to enable rims thereon to engage said projections to set said terminal withdrawal stopper in said temporary engagement stage in said housing with said plug pieces out of engagement with said housing lock pieces, a projecting rim on each housing side wall at a position below said terminal sockets, and a ridge on each outside plug piece engageable with said projecting rim to limit the extent of insertion of said terminal withdrawal stopper to said temporary engagement stage in said housing, said projecting rims and said ridges being releasably engageable to permit movement of said terminal withdrawal stopper to said full engagement stage in said housing with said plug pieces in engagement with said housing lock pieces.

2. The combination according to claim 1 wherein said plug pieces each include a plugging side and a connected side and a connecting piece for connecting said plug pieces at said connected side.

3. The connector as set forth in claim 2, wherein the bottom surface of said projection provided at said side wall is inclined to facilitate said window of the associated plug piece to ride over said projection in the temporary engagement stage and the top surface of said projection is flat to retain the top rim of the window in the temporary engagement stage.

4. The connector as set forth in claim 1 or claim 2, wherein the bottom surface of said projecting rim provided at said side wall is inclined to enable said ridge of said plug piece to abut against it in the temporary engagement stage and to facilitate said projecting rim into the ridge to ride over the full engagement stage and the top surface of said projecting rim being flat to retain the bottom rim of the ridge in the full engagement stage.

* * * * *